United States Patent [19]

Hurst

[11] Patent Number: 4,884,688

[45] Date of Patent: Dec. 5, 1989

[54] TOOTH BRUSH CASE

[76] Inventor: Joseph S. Hurst, 809 S. Damen Ave., Chicago, Ill. 60612

[21] Appl. No.: 179,659

[22] Filed: Apr. 11, 1988

[51] Int. Cl.[4] ..... B65D 81/22; A46B 17/06

[52] U.S. Cl. ..... 206/362.2; 15/248 R; 132/308; 206/15.2; 206/209.1; 211/66; 422/300

[58] Field of Search ..... 206/361, 362.1, 362.2, 206/362.3, 209.1, 209, 205, 15.2, 15.3; 211/65, 66, 74; 312/209; 422/300; 215/2, 1 R; 141/164, 319; 15/145, 167.1, 248 R; 132/308, 310, 311; D6/528, 534

[56] References Cited

U.S. PATENT DOCUMENTS

| | | | |
|---|---|---|---|
| 757,885 | 4/1904 | Cochrane | 206/209 |
| 1,188,845 | 6/1916 | Scovell | 206/15.2 X |
| 1,200,236 | 10/1916 | Ray et al. | 206/362.2 |
| 1,212,335 | 1/1917 | Feinberg | 206/209.1 |
| 1,274,133 | 7/1918 | Ausubel | 206/362.2 |
| 1,283,403 | 10/1918 | Eustis | 206/209.1 X |
| 1,348,062 | 7/1920 | Shook | 215/1 R |
| 1,419,593 | 6/1922 | Thompson | 422/300 X |
| 1,448,231 | 3/1923 | Momson | 206/209.1 |
| 1,459,831 | 6/1923 | Jones | 206/209.1 |
| 1,488,961 | 4/1924 | Walbridge | 206/362.2 |
| 1,553,648 | 9/1925 | Thompson | 206/15.2 X |
| 1,556,148 | 10/1925 | Knolt | 206/209.1 |
| 1,935,781 | 11/1933 | Ochse | 206/362.3 |
| 2,394,640 | 2/1946 | Singer | 15/248 R |
| 2,630,912 | 3/1953 | Warner et al. | 206/15.2 |
| 3,755,848 | 9/1973 | Mutrie | 15/248 R |

*Primary Examiner*—Bryon P. Gehman

[57] ABSTRACT

A tooth brush case is provided having a separable handle and liquid reservoir, the handle portion of the tooth brush being securely engaged in the handle of the case and the bristle portion of the tooth brush being received into the liquid reservoir when the device is closed. The reservoir is free-standing and includes a filler opening adapted to fit a mouth of a commercially available sterilizing or mouth wash solution. An abbreviated handle portion is provided in a second embodiment.

6 Claims, 1 Drawing Sheet

10
12
14
16
18
20
22
24
26
28
30
32
34
36
40
42
44
46a
46b
48
50
52
54
56
60
62
64
66
H
T
C
B
S
L
III
VIII

TOOTH BRUSH CASE

BACKGROUND OF THE INVENTION

1. Field of the Invention

The present invention relates generally to a case for enclosing a tooth brush and a cleansing or sterilizing liquid.

2. Description of the Related Art

It is recognized in the prior art to provide a sterilizing container for a tooth brush using sterilizing gases. In particular, U.S. Patent to Moseley et al. U.S. Pat. No. 1,051,433 discloses a tooth brush holder and sterilizer having a tubular shape with an open lower end on which is threadably connected a bottom member which holds a perforated box in a clip. A compressed tablet which gives off formaldehyde gas is held in the perforate box. A top or cap member is hinged at an opposite end of the tubular body and includes one or more openings for ventilating the holder.

U.S. Patent to Dye U.S. Pat. No. 1,122,881 discloses a tooth brush holder and sterilizer having a cylindrical casing to which is fastened a threaded cap. An internal projection on the cap forms a germicide holder for receiving cotton or wool saturated with formaldehyde to supply germicidal gas or vapor into the casing.

In the Feinberg U.S. Pat. No. 1,212,335 is disclosed a tooth brush holder and sterilizer which includes an elongated tubular sleeve closed at a lower end except for a small outlet hole that is selectively closeable by a rotatable cap. At an opposite end is a partitioned off container within which is contained a sterilizing agent saturated in absorbent-cotton or other wick material. Frusto-conical baffle plates are also provided within the holder. In a second version, two side-by-side chambers for two tooth brushes are provided with baffles and a single antiseptic container.

In U.S. Pat. No. 615,357 to Johnson et al. is disclosed a tooth brush holder having a shell hinged at one end to receive the bristle portion of a tooth brush and hinged at another end for receiving an antiseptic tablet, the tablet being separated from the tooth brush by a perforated partition.

A U.S. Patent to Fowler U.S. Pat. No. 1,074,169 discloses an antiseptic tooth brush receptacle having a rectangular container hinged at one end and including a carrier or holder for disinfectant formed of absorbent material.

In the Pat. No. 1,137,651 to Metivier is disclosed a brush with a hinged handle including a protector for covering the bristles. When the handle is moved to the closed position, a threaded portion is formed for engagement with a cap.

SUMMARY OF THE INVENTION

An object of the present invention is to provide a clean, fresh smelling tooth brush each time the tooth brush is used.

Another object of the present invention is to reduce the risk of reinfection and the risk of reoccurrence of a disease in a tooth brush user by germs carried on a tooth brush.

A further object of the present invention is to provide a liquid-tight travel case for a tooth brush which prevents liquid on the tooth brush from escaping into luggage and the like.

Yet another object of the invention is to provide a unitary container for a tooth brush and for a mouth rinse solution. An additional object is to provide a free-standing tooth brush case and mouth rinse solution container.

These and other objects of the invention are achieved in a tooth brush case having a handle into which a handle portion of the tooth brush is received and having a reservoir for holding a liquid, such as a sterilizing liquid or mouth rinse liquid, and into which the bristle or head portion of the tooth brush is received. The two parts of the brush case are fastenable together in sealing engagement to prevent the liquid from leaking. The reservoir portion of the present brush case is self-standing to prevent the liquid from spilling during use of the tooth brush. A filler opening is provided in the reservoir through which the liquid is filled. Preferrably, the filler opening accepts a commercially available antiseptic or mouthwash solution container so that the reservoir may be filled without risk of spilling the solution and without risk of contaminating the solution.

In a preferred embodiment, the handle of the present tooth brush case completely encloses the handle portion of the tooth brush to ensure a liquid-tight container when the handle and reservoir are joined. Complete enclosure of the tooth brush handle also prevents contact with the tooth brush by the hands of the tooth brush user as well as contamination from other sources. The handle in an advantageous development is fastenable over the mouth of a container of commercially available solution so that the container may be used in place of the reservoir. A storage hook extends from an end of the handle of the preferred embodiment by which the brush case is suspended.

In an alternate embodiment, an abbreviated handle is provided for fastening on the reservoir. The abbreviated handle covers only part of the tooth brush handle to provide a more compact structure yet still provides a liquid-tight container.

The reservoir of the present tooth brush case may hold either an antiseptic or other sterilizing solution, a mouthwash solution, or a clean water supply. Thus, a fresh smelling, clean tooth brush is provided each time the tooth brush is used with a reduced risk of contamination by germs and with a reduced risk of reinfection by cold virus, streptococcus pathogens, and the like. The liquid retained in the reservoir may be used to rinse the tooth brush and/or may be used as a mouth wash or rinse solution for the user of the tooth brush. Thus, the present case is particularly handy when traveling or when in an office setting or the like. It may also be used in locations having unclean or unfiltered water supplies since a supply of liquid accompanies the tooth brush.

DESCRIPTION OF THE PREFERRED EMBODIMENTS

Figures 1, 2, 3, 4, 5, 6, 7, 8:
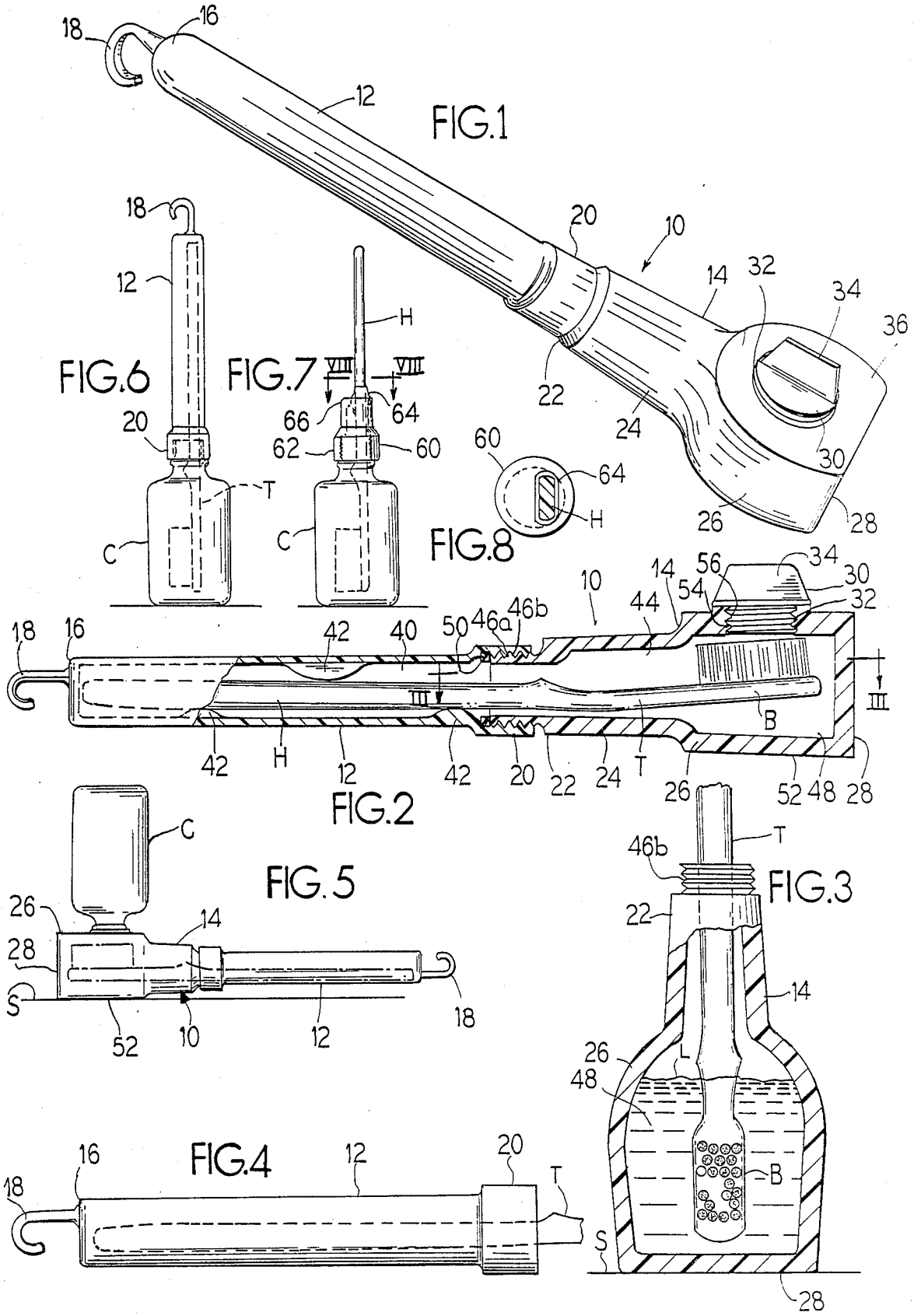
FIG. 1 is a perspective view of a preferred embodiment of a tooth brush case according to the principles of the present invention.
FIG. 2 is a partial longitudinal cross section of the tooth brush case of FIG. 1 showing a tooth brush held therewithin.
FIG. 3 is a lateral cross section of the reservoir of the tooth brush case along line III—III of FIG. 2.
FIG. 4 is a side elevational view of the handle of the tooth brush case of the present invention.
FIG. 5 is a side elevational view of the tooth brush case of the present invention having a container for a commercially available antiseptic or mouthwash solution secured in the fill opening.
FIG. 6 is a side elevational view showing the handle of the present tooth brush case fastened to a container for a commericially available antiseptic or mouthwash solution.
FIG. 7 is a side elevational view of an abbreviated handle of a second embodiment of the present invention shown fastened in a mouthwash container.
FIG. 8 is a cross section of the abbreviated handle of the second embodiment along line VIII—III of FIG. 7.

Referring first to FIG. 1, a tooth brush case 10 is shown having a handle 12 and a reservoir 14. The handle 12 is of an elongated cylindrical shape having a closed first end 16 from which extends a hook or hanging member 18 by which the brush case 10 is suspended. A second opposite end 20 of the handle 12 has an enlarged diameter relative to the cylindrical portion. The handle 12 can also be of other shapes including having finger indentations or projections and/or being of a non-round shape to inhibit rolling.

The reservoir 14 is fastened to the enlarged diameter end 20 of the handle portion 12 at an end 22 of a neck 24. The neck 24 extends between the end 22 and a bulb portion 26 having a flat end surface 28. The bulb portion 26 includes a plug 30 that fits into an opening 32 in the bulb 26. In the illustrated embodiment, the plug 30 has a handle 34 for manual removal of the plug 30 by a user. Also in the illustrated embodiment, the bulb 26 has a flat front surface 36 in which the opening 32 s provided.

With reference to FIG. 2, a tooth brush T is shown within the brush case 10 having an elongated handle portion H and a bristle or head portion B, as is common in the known tooth brushes. The handle portion H of the tooth brush T extends into a hollow interior space 40 defined by wall portions of the handle 12 where it is engaged by projecting wall portions 42 on an interior surface of the wall portions. The projecting wall portions 42 securely engage the handle H of the tooth brush T from alternate sides at spaced intervals and prevent it from slipping therefrom. The projections 42 enable tooth brush handles H of various types and designs to be held in the handle 12, since the tooth brush handles H can flex somewhat. Some flexing of the handle 12 also occurs. In a slightly different embodiment, the interior wall portions of the handle gradually taper inwardly along the handle 12 and thereby securely engage a variety of tooth brush handle shapes. The projections 42 can either be integrally formed with the handle 12 as wide projections or narrow ribs, or can be rubber or some other flexible inserts in the handle portion 12. Insertable flexible gasket type members are also contemplated as a means for holding the tooth brush T in the handle 12.

The reservoir portion 14 likewise includes a hollow interior space 44 defined by a liquid-tight reservoir wall portion which receives the bristle or brush portion B. The enlarged diameter portion 20 of the handle 12 has an interior threaded surface **46*a* which is threadably received onto exterior threads 46*b* on the first end 22 of the reservoir portion 14. The interior space 44 in the reservoir portion 14 is large enough in the threaded first end 22 and in the neck 24 to enable the bristle portion B of the tooth brush T to be inserted and removed therefrom. A somewhat larger interior space 48 is provided in the bulb 26 for clearance of the bristles B as the tooth brush T rotates during threaded engagement and disengagement of the handle 12 with the reservoir 14. A gasket 50 may be provided, such as in the enlarged diameter portion 20 to ensure that a liquid-tight seal is formed when the handle 12 and reservoir 14 are fastened together. Of course, other types of connections may be provided between the handle 12 and reservoir 14**.

The bulb portion 26 not only has the flat end surface 28 but also preferrably has a flat back surface 52. Opposing the flat back surface 52 is the plug 30 mounted in the fill opening 32. In the illustrated embodiment, the plug 30 includes a threaded cylindrical extension 54 in threaded engagement into the threaded opening 32. A gasket 56 is likewise provided to guarantee a liquid-tight seal between the reservoir 14 and the plug 30. As can be seen in FIG. 2, the bulb portion 26 enables curved as well as straight tooth brushes T to be used while still providing clearance for the bristles B. It is possible with some tooth brushes that the bristles will rub the walls of the bulb 26 or neck 24. This is permissible so long as the tooth brush is not damaged.

In FIG. 3 is shown the reservoir portion 14 including the somewhat larger interior space 48 within the bulb 26. The reservoir portion 14 is shown resting on a surface S so that the flat end surface 28 supports the reservoir portion 14 in an free-standing upright position. When in the free-standing upright position, a liquid L is retained within the reservoir portion 14 even when the handle 12 is removed and the tooth brush 7 is in use. The brush case 10 also stands on the surface 28 when the handle 12 is attached so that the bristle portion B of a toothbrush T extends into the liquid L. Although the liquid L may be any liquid, it is preferrably a sterilizing liquid or a mouthwash or mouth rinse for maintaining the tooth brush in a fresh, clean smelling, and generally germ-free condition. The threaded portion **46*b* at the end 22 of the reservoir portion 14** can be seen.

Referring to FIG. 4, the handle portion 12 of the tooth brush case 10 is shown separated from the reservoir portion 14. The hook 18 extends from the closed end 16 for hanging the handle 12, with or without the reservoir 14 attached, such as to dry the tooth brush T. The tooth brush T extends from the enlarged second end 20 and so may be used while in the handle 12. When the handle portion 12 is removed from the reservoir portion, the tooth brush T is held securily within the handle portion 12 so that a tooth brush user can brush their teeth simply by holding the handle portion 12. In this way, germs carried by the hand do not contact the tooth brush itself nor does the liquid L reach the hands of the user. Any liquid on the tooth brush T runs into the handle portion 12 and not onto the hands of the user, keeping the users hands dry and the liquid free of contamination.

Referring now to FIG. 5, the tooth brush case 10 is shown in a substantially horizontal position resting on the flat rear surface 52 of the bulb portion 26. The plug 30 has been removed from the opening 32 and a container C received therein. In particular, the threaded opening 32 matches threads on the mouth of the container C so that a substantially liquid-tight and secure engagement is formed when the container C is fastened into the opening 32. In a preferred use, the container C which, for example, is a container of commercially available sterilizing or mouthwash solution is threaded into the opening 32 with the tooth brush case 10 in an position inverted from that shown in FIG. 5. Thereafter, the container C and tooth brush case 10 are inverted into the position shown in FIG. 5 so that liquid contained within the container C pours into the present case 10 without risk of spilling or contamination. Thereafter, the container C is removed and the plug 30 replaced in the opening 32. The tooth brush case 10 is now charged with a supply of the liquid L.

In FIG. 6, the handle portion 12 has been removed from the reservoir portion 14 and the enlarged, internally threaded portion 20 threaded over the mouth of the container C. The bristle portion B of the tooth brush T, thus, extends into the container C and the container C and handle portion 12 form a liquid-tight container. Therefore, should the reservoir portion 14 become lost or broken, it is still possible to use the present device by substituting a container C of commercially available sterilizing or mouthwash solution for the reservoir 14. The enlarged portion 20 of the handle 12 and the opening 32 in the reservoir 14 are preferably of the same size and shape to fit the same container C. Other fastening means may be provided for fastening to other types or sizes of containers, as well.

In FIG. 7, a second embodiment of the invention has a handle 60 which is abbreviated relative to the longer handle 12 shown in the preferred embodiment. Like the first embodiment, the handle of FIG. 7 includes an internally threaded, enlarged end 62 which is threadably connectable to a container C as shown in FIG. 7 or to the reservoir portion 14 of the preferred embodiment. In addition, the shortened handle 60 includes a gasket 64 which provides a seal between an end 66 of the handle 60 and the handle portion H of the tooth brush T. The tooth brush handle H extends through the abbreviated handle 60 where it is grasped by a user during use.

In the cross section of FIG. 8, the gasket 64 can be seen providing a seal between the tooth brush handle H and the abbreviated handle 60. Although offset somewhat in FIG. 8, the handle portion H may also be centered in the handle 60.

Thus, there has been shown and described a tooth brush case 10 for containing both a tooth brush T and a sterilizing or mouthwash solution L. The tooth brush case 10 not only provides a liquid-tight case in which the tooth brush T is enclosed when not in use, but also provides a handle 12 for grasping during use of the tooth brush T as well as a separable free-standing liquid reservoir 14 for containing a mouth rinse solution or sterilizing liquid L. A conveniently placed opening 32 provides easy filling of the reservoir portion 14 and is preferrably adapted for fastening over the mouth of a commercially available mouthwash solution container C so that the reservoir 14 can be filled without risk of spilling or contamination. The handle portion 14 is adapted to fit on the mouth of the mouthwash or sterilizing solution container C to thereby expand the usefullness of the present device.

Although other modifications and changes may be suggested by those skilled in the art, it is the intention of the inventor to embody within the patent warranted hereon all changes and modifications as reasonably and properly come within the scope of his contribution to the art.

I claim:

1. A tooth brush case for holding a tooth brush and a liquid, comprising:

a hollow elongated handle so dimensioned as to extend over a handle portion of a tooth brush, said handle having means for engaging the tooth brush handle portion in snug engagement;

a free-standing liquid-tight reservoir able to hold a liquid when in a free-standing position and so dimensioned as to selectively enclose a bristle portion of the tooth brush when said reservoir is fastened to said handle;

means for selectively fastening said handle to said reservoir in liquid-tight engagement to provide a liquid-tight closed case;

a selectively openable filling opening in a front surface of said reservoir; and means for selectively sealing said filling opening in liquid-tight engagement.

2. A tooth brush case as claimed in claim 1, wherein said selectively sealing means is a cap, and said filling opening includes cooperating threaded portions in said filling opening and on said cap.

3. A tooth brush case as claimed in claim 1, further comprising: a support surface on said reservoir opposite said filling opening for supporting said reservoir on a horizontal surface with said filling opening directed upwardly.

4. A case for a tooth brush and a liquid, comprising:

a handle means having a wall portion defining an interior space for receiving a handle of a tooth brush, the interior surface of said wall portion having engaging means for secure frictional engagement with the handle of the toothbrush, said handle means having a first open end with a first fastening portion and a second opposite end that is closed in a liquid tight fashion when the handle of the tooth brush is received in said handle means;

a reservoir means having a liquid-tight reservoir wall portion defining a reservoir interior space for receiving a brush portion of the tooth brush engaged in said handle means when said handle means is fastened to said reservoir means, said reservoir wall portion including an opening into said reservoir interior space, said reservoir wall portion having a second fastening portion about said opening, said second fastening portion being connectable in liquid-tight engagement with said first fastening portion of said handle means, said reservoir wall portion including at least one surface with a filler opening into said reservoir interior space; and a selectively closeable cap connectable in a liquid-tight engagement in said filler opening in said surface.

5. A case as claimed in claim 4, wherein said reservoir wall portion includes a neck portion about said opening into said reservoir interior space and a bulb portion of enlarged interior diameter relative to said neck portion.

6. A case for a tooth brush and a liquid, comprising:

a handle means having a wall portion defining an interior space for receiving a handle of a tooth brush, said wall portion including engaging means for contacting the handle of the tooth brush in secure engagement, said handle means having a first open end with a first fastening portion and a second opposite end that is closed in liquid-tight fashion when the tooth brush is received in said handle means, a reservoir means having a liquid-tight reservoir wall portion defining a reservoir interior for receiving a brush portion of the tooth brush, said reservoir wall portion including an opening having a second fastening portion connectable in liquid-tight engagement with said first fastening portion of said handle means, said reservoir wall a neck portion and a bulb portion of enlarged interior diameter relative to said neck portion, said bulb portion including at least two substantially flat exterior surfaces, a first of said substantially flat surfaces being opposite said opening so that said reservoir means retains liquid when rested on said first surface, a second of said substantially flat surfaces being opposite a selectively sealable filler opening in said reservoir means.

* * * * *